United States Patent [19]

Bianco

[11] 4,257,288

[45] Mar. 24, 1981

[54] WRENCH

[75] Inventor: Andrew S. Bianco, Lima, Ohio

[73] Assignee: Huffy Corporation, Miamisburg, Ohio

[21] Appl. No.: 22,020

[22] Filed: Mar. 19, 1979

[51] Int. Cl.[3] ..... B25B 13/52

[52] U.S. Cl. ..... 81/66 R; 81/64

[58] Field of Search ..... 81/64, 66 R, 67 R, 3.43

[56] References Cited

U.S. PATENT DOCUMENTS

| | | | |
|---|---|---|---|
| 1,024,167 | 4/1912 | Whitcomb | 81/66 R |
| 1,466,196 | 8/1923 | Seiders | 81/64 |
| 1,521,342 | 12/1924 | Thomas et al. | 81/64 |
| 1,598,561 | 8/1926 | Coomer | 81/64 |
| 1,670,583 | 5/1928 | Lawrence | 81/64 |

*Primary Examiner*—James L. Jones, Jr.

*Attorney, Agent, or Firm*—Biebel, French & Nauman

[57] ABSTRACT

A wrench particularly adapted for removing automotive oil filters and similar cannister type filters without crushing the relatively thin outer shell of the filter. The wrench includes a relatively wide, flat, flexible metal strap having a length less than the circumference of the filter and pivotally connected at one end to an end of a rigid handle. The strap carries a pivotally mounted hook at its opposite end and the hook is adapted to engage the cross pins of a link chain which is pivotally connected at one end to the handle at a point spaced inwardly from the end of the handle to which the strap is attached.

1 Claim, 3 Drawing Figures

WRENCH

BACKGROUND OF THE INVENTION

A variety of chain-type wrenches are well known, ranging from the relatively simple construction shown in the 1894 U.S. patent to Streeter et al, U.S. Pat. No. 520,712, to more complex designs as shown in U.S. Pat. Nos. 1,826,045 of 1931; 3,387,513 of 1968; and 3,505,914 of 1970.

Each of the tools described in the above noted patents are adapted to engage cylindrical members such as pipes within a range of diameters and exert a gripping force on the pipe as torque is imposed on the pipe. However, it has been found that when applied to a relatively fragile member such as the thin walled shell of a disposable, cannister-type oil filter, chain wrenches tend to crush the shell.

A variation of the conventional chain-type wrench is disclosed in U.S. Pat. No. 3,885,479 of 1975, wherein a series of pivotally interconnected, curved links are used instead of the more conventional chain construction. This design, while specifically described for removing oil filters, is obviously more expensive than a chain wrench and of course, is more restricted in the range of sizes it can accommodate.

U.S. Pat. No. 1,670,583 of 1928 discloses a clamp designed for removing jar tops, and includes a flexible metal band connected to one end of a jaw of a pair of pliers and carrying a chain which overlies a portion of the band and is attached to it at opposite ends of the chain. The other jaw of the pliers carries a hook which is engageable with the chain so that when the handles of the pliers are squeezed together a jar top may be gripped by the band.

With this construction it will be apparent that the gripping force exerted on the jar top is dependent upon the force applied to the plier handles, and the smooth inner surface of the band will tend to slip about the jar top if insufficient force is applied to the plier handles. Additionally, the cost of this type of construction will obviously be greater than that of more conventional chain-type wrenches.

SUMMARY OF THE INVENTION

A wrench in accordance with the present invention is of relatively inexpensive construction, adapted to engage articles of a relatively wide range of sizes, is self-tightening, and is particularly adapted for engaging relatively fragile articles, such as the thin shell of a cannister type, disposable filter.

Thus, a wrench in accordance with the present invention includes basically a handle, a strap pivotally attached to one end of the handle, a hook pivotally mounted on an end of the strap opposite the point of connection of the strap to the handle, and a chain pivotally attached at one end to the handle at a point on the handle spaced from the point of connection of the strap.

The strap is relatively wide as compared to its thickness, for example, about an inch and a quarter wide and about 0.05 inch thick, and is relatively flexible, having a hardness of about Rockwell 50 on the B scale, so that the strap will conform readily to different size filters.

The relatively broad flat strap, of course, distributes the force applied to the filter over a relatively wide area as compared to the area which would be involved with a conventional chain-type wrench, thereby reducing the likelihood of the filter being crushed as pressure is applied to it by the wrench.

The length of the strap is selected such that it will be somewhat shorter than the circumference of the smallest filter expected to be encountered. For example, normally filters of this type will run in the range of about 75 mm or a little under 3 inches in diameter up to about 5¼ inches in diameter, while the length of a typical wrench strap in accordance with the present invention would be about 8½ inches.

As a result, although the strap will not crush the filter, as the wrench is tightened about the filter the ends of the strap will tend to dig into the filter and enhance the gripping action of the wrench on the filter as the wrench is tightened.

It will also be noted that the point of connection of the chain to the handle is spaced inwardly from the end of the handle where the strap is pivotally connected. As a result, as the handle is turned in a direction to remove the filter, the wrench tightens about the filter. Thus, there is no need to exert an independent clamping force on the filter since the wrench is self-tightening.

These and other features and advantages of the present invention will become more apparent from the following detailed description.

DESCRIPTION OF THE PREFERRED EMBODIMENT

Figure 1:
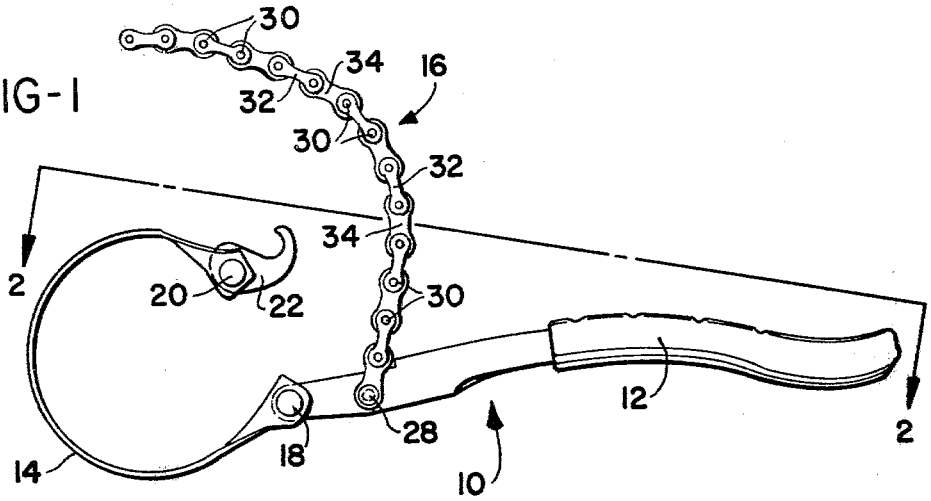
FIG. 1 is a plan view of the wrench of the present invention.
Figure 3:
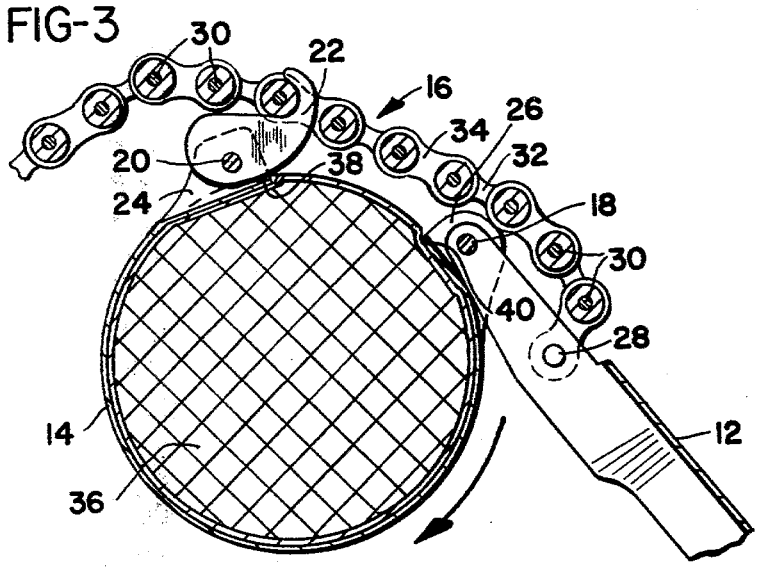
FIG. 3 shows a portion of the wrench in engagement with a filter.

As seen in FIGS. 1 and 3 of the drawings, the wrench 10 of the present invention includes a substantially rigid handle 12, a relatively broad flat flexible strap 14, and a chain 16. A rivet or the like 18 pivotally connects the strap adjacent one of its ends to an end of the handle 12 and a similar rivet or the like 20 pivotally attaches a hook 22 to an opposite end of the strap 14.

Figure 2:
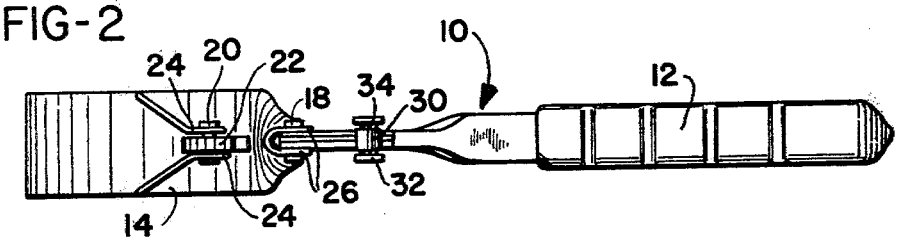
FIG. 2 is a view taken along line 2—2 of FIG. 1.

As can best be seen in FIG. 2 of the drawings, the opposite ends of the strap 14 are turned outwardly to form pairs of ears 24 and 26 through which the rivets 18 and 20, respectively, pass. A third rivet or the like 28 passes through one end of the chain 16 and pivotally connects it to the handle 12 at a point thereon spaced inwardly from the outer end of the handle to which the strap is pivotally attached.

The chain 16 comprises a series of regularly spaced pins 30 interconnected by spaced pairs of side plates 32 and 34 and it will be seen that the spacing of the side plates is such that the hook 22 can pass between them and engage the pins 30. This is shown in FIG. 3 of the drawings where the wrench is shown applied to a filter 36 with a force applied to the handle in the direction indicated by the arrow.

In applying the wrench to the filter it should be noted that the hook may be first engaged with the chain to provide an overall circumference for the wrench slightly larger than the circumference of a filter or, where space limitations prevent slipping the wrench over the end of the filter, the flexible strap can be wrapped around the filter and the hook then engaged with the chain. In either case, as force is applied to the wrench handle in a direction indicated by the arrow, the strap and chain tighten about the circumference of the filter causing the ends 38 and 40 to dig in slightly into the filter, further enhancing the gripping force applied to the filter.

From the above it will be seen that the present invention provides a relatively inexpensive wrench particularly adapted for removing oil filters, which is adjustable to a wide range of filter circumferences, is self-tightening, non-collapsing, and provides a positive engagement with a filter being removed.

While the form of apparatus herein described constitutes a preferred embodiment of the invention, it is to be understood that the invention is not limited to this precise form of apparatus, and that changes may be made therein without departing from the scope of the invention.

What is claimed is:

1. A wrench comprising:

a substantially wide, flat, flexible metal strap having a length less than the circumference of an article to be gripped by said wrench, a single, substantially rigid handle, means pivotally connecting said strap adjacent a first end thereof to an end of said handle, a link chain consisting of a series of regularly spaced pins interconnected by pairs of spaced side plates, said pins and side plate defining open areas between each of said pairs of side plates and adjacent pins, means permanently connecting said chain adjacent a first end thereof only to only said handle at a position on said handle spaced inwardly from said end thereof, a single hook movable into said open areas and engageable with said pins of said chain, and means pivotally mounting said hook on said strap adjacent a second end thereof.

* * * * *